US006494748B1

(12) United States Patent
Mori et al.

(10) Patent No.: US 6,494,748 B1
(45) Date of Patent: Dec. 17, 2002

(54) BUTT TYPE CONTACT TERMINAL

(75) Inventors: Shigeo Mori, Shizuoka (JP); Kazuhisa Ishizaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/713,255

(22) Filed: Nov. 16, 2000

(30) Foreign Application Priority Data

Nov. 16, 1999 (JP) ..... 11-325282

(51) Int. Cl.[7] ..... H01R 13/24
(52) U.S. Cl. ..... 439/700
(58) Field of Search ..... 439/289, 700, 439/824

(56) References Cited

U.S. PATENT DOCUMENTS

| | | | | | |
|---|---|---|---|---|---|
| 3,771,110 | A | * | 11/1973 | Reed | 439/737 |
| 4,176,905 | A | | 12/1979 | Marechal et al. | |
| 4,553,192 | A | * | 11/1985 | Babuka et al. | 361/395 |
| 4,591,222 | A | * | 5/1986 | Shaffer | 439/265 |
| 4,655,526 | A | * | 4/1987 | Shaffer | 439/268 |
| 4,904,213 | A | * | 2/1990 | Hock et al. | 439/824 |
| 5,133,680 | A | * | 7/1992 | Watson et al. | 439/824 |
| 5,151,040 | A | * | 9/1992 | Tanaka | 439/73 |
| 5,417,595 | A | * | 5/1995 | Cullen et al. | 439/700 |
| 5,641,315 | A | * | 6/1997 | Swart et al. | 439/824 |
| 5,807,123 | A | * | 9/1998 | Shiegelaar et al. | 439/188 |
| 5,823,832 | A | | 10/1998 | Das | |
| 5,879,198 | A | * | 3/1999 | Sekimori et al. | 439/700 |
| 6,075,318 | A | * | 6/2000 | Noll et al. | 313/573 |
| 6,159,055 | A | * | 12/2000 | Satitpunwaycha et al. | 439/700 |

FOREIGN PATENT DOCUMENTS

| | | | |
|---|---|---|---|
| DE | 839 216 | 5/1952 | |
| DE | 195 27 425 | 1/1997 | |
| GB | 863 389 | 3/1961 | |
| JP | 6-267699 | 9/1994 | H05H/7/04 |

OTHER PUBLICATIONS

Patent Abstracts of Japan abstracting JP 09–027369 published Jan. 28, 1997.

* cited by examiner

*Primary Examiner*—Brian Sircus
*Assistant Examiner*—Thanh-Tam Le
(74) *Attorney, Agent, or Firm*—Sughrue Mion, PLLC

(57) ABSTRACT

A butt type contact terminal is disclosed having a plate-like tab portion at one end and an electric wire connecting portion on the other end, one face of the tab portion serving as a contact face. A resilient member is pressed into contact with the other face of the tab portion such that the tab portion moves in a direction of its thickness against a biasing force of the resilient member when a mating terminal is pressed into contact with the contact face. Positioning holes are formed in the tab portion and positioning pins are provided on a first wall member. Engaging portions with respect to the positioning pins are provided on a second wall member and the resilient member is supported by the second wall member. An insertion hole for receiving the mating terminal is formed in the first wall member.

13 Claims, 4 Drawing Sheets

BUTT TYPE CONTACT TERMINAL

BACKGROUND OF INVENTION

1. Field of Invention

The present invention relates to a structure of a butt type contact terminal employed in a power supplying connector or a power receiving connector in an electric car, for example, and having a structure in which the terminal is adapted to slide by way of a coil spring when the connector is engaged or disengaged.

2. Field of Invention

FIG. 5 shows a structure of a conventional butt type contact terminal.

This structure of the butt type contact terminal is applied to the power supplying connector of the electric car, for example, and includes a front end portion 62 and a rear end portion 63 made of conductive metal, a braided wire 64 for connecting the front end portion 62 to the rear end portion 63, and a coil spring 65 resiliently provided between the front end portion 62 and the rear end portion 63 for expanding the braided wire 64.

The braided wire 64 is press-fitted and connected to the front end portion 62 and the rear end portion 63. An electric wire 66 for power supply is connected to the rear end portion 63. When the power supplying connector (not shown) having the structure of the butt type contact terminal is connected to the power receiving connector (not shown) in a vehicle, the front end portion 62 is abutted against a terminal of the power receiving connector to retreat against a force of the coil spring 65, and at the same time, the braided wire 64 is contracted. Electric current flows from the electric wire 66 to a contact 62*a* at a forward end of the front end portion 62 by way of the braided wire 64, and from the contact 62*a* through the power receiving connector to be charged into a battery in the vehicle.

However, in the above described conventional structure of the butt type contact terminal, the braided wire 64 is passed inside the coil spring 65, and the front end portion 62 and the rear end portion 63 must be press-fitted and connected to the braided wire 64 in a state where the coil spring 65 is contracted. Therefore, there have been such problems that the structure is complicated, and takes an annoying assembling work, thus, incurring a high cost.

In addition, because on each occasion of battery charging, (each time when the power supplying connector and the power receiving connector are engaged with and disengaged from each other), the braided wire 64 is expanded and contracted, it has been a problem that the braided wire 64 is apt to be cut, and electric resistance is increased resulting in a deterioration of electrical efficiency.

SUMMARY OF INVENTION

In view of the above described problems, it is an object of the invention to provide a structure of a butt type contact terminal which has a simple structure, can be easily assembled and manufactured at a low cost, and will not be damaged after repeated contacts with a mating connector, enabling the electrical efficiency to be always maintained at a high level.

In order to attain the above described object, the invention employs a structure of a butt type contact terminal characterized in that it comprises a butt type contact terminal having a plate-like tab portion, one face of the tab portion being defined as a contact face, and a resilient member pressed into contact with the other face of the tab portion, wherein the tab portion moves in a direction of its thickness against a biasing force of the resilient member when a mating terminal is pressed into contact with the contact face.

It is also effective that the tab portion is provided with a thrusting projection having the contact face. Moreover, it is also possible that the butt type contact terminal includes an electric wire press-fitting portion.

Further, it is also effective that the tab portion is provided with positioning holes, and positioning pins to be inserted in the positioning holes are provided on a first wall member, the tab portion being adapted to be pressed into contact with the first wall member by means of the biasing force of the resilient member. Still further, it is also effective that engaging portions with which forward ends of the positioning pins are engaged are provided on a second wall member, and the resilient member is supported by the second wall member.

Furthermore, it is also effective that the first wall member is provided with an insertion hole for receiving the mating terminal, and the one face of the tab portion faces with the insertion hole. Still further, it is also effective that the thrusting projection is positioned in the insertion hole. Still further, it is also effective that a tapered portion of the mating terminal is abutted against an end edge of the insertion hole.

Furthermore, it is also effective that the tab portion is folded, and an electric wire extending from the electric wire press-fitting portion is guided out in a folded direction of the tab portion.

DETAILED DESCRIPTION OF PREFERRED EMBODIMENTS

Figure 1:
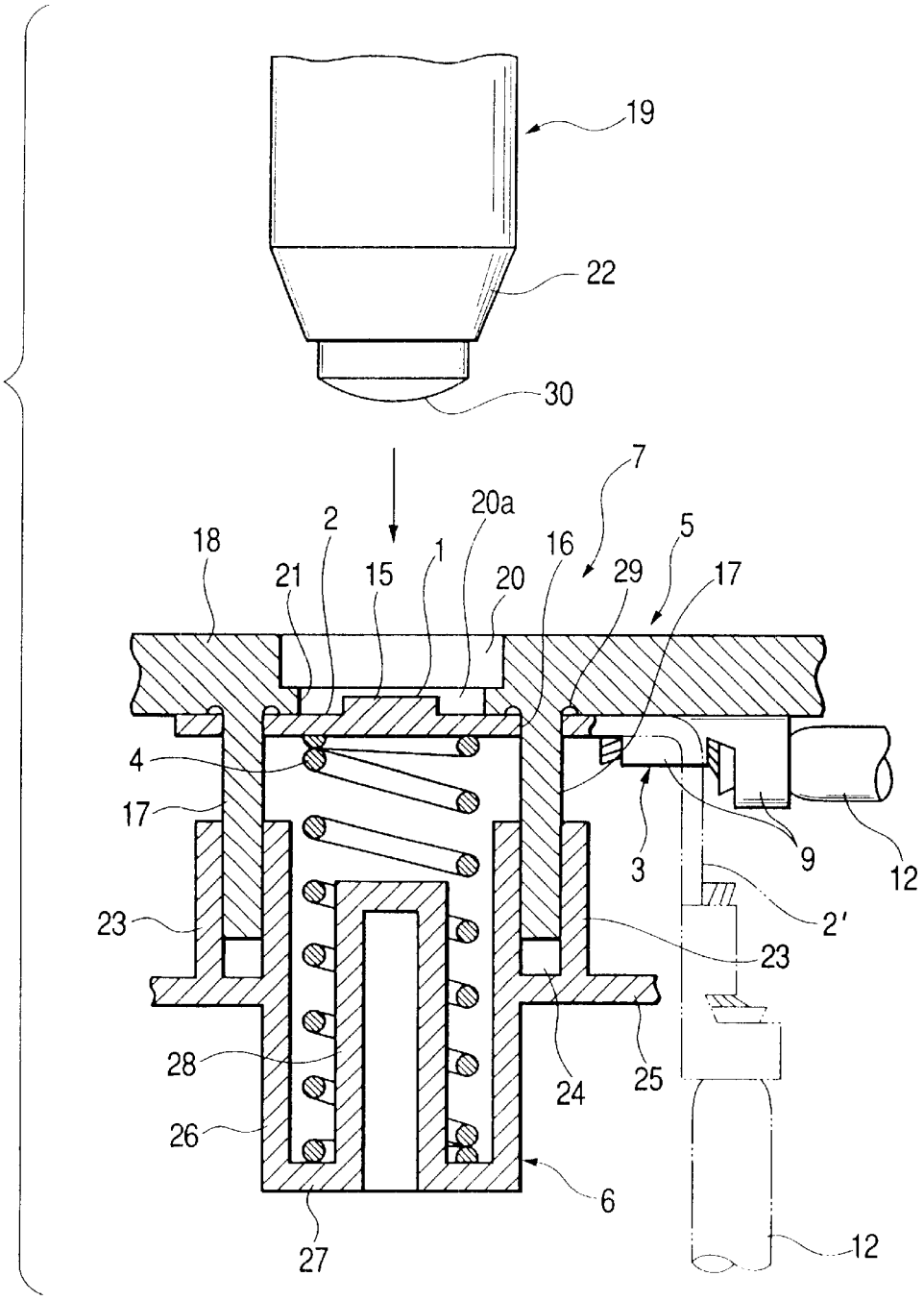
FIG. 1 is a sectional view showing one embodiment of a structure of a butt type contact terminal according to the invention.

Now, an embodiment of the invention will be described in detail, referring to the drawings.

Figure 2A:
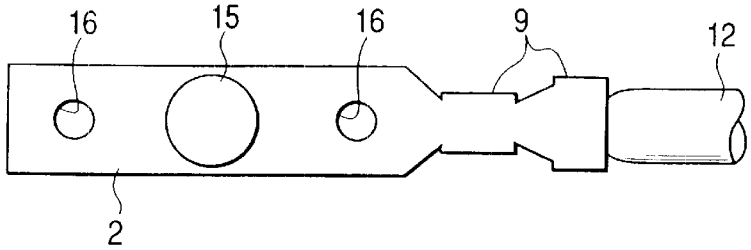
FIG. 2(*a*) is a plan view of a butt type contact terminal, and (*b*) is a side view of the butt type contact terminal showing a tab portion in a longitudinal section.
Figure 2B:
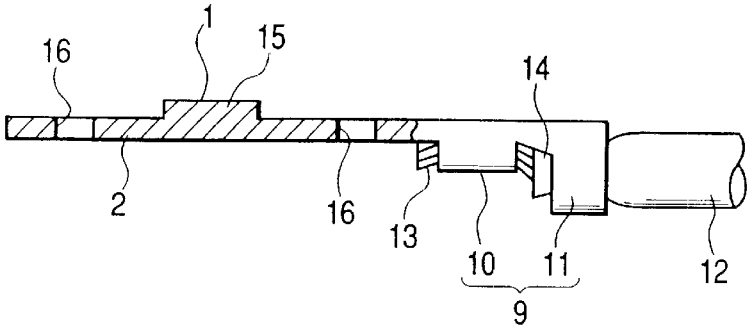
Figure 3:
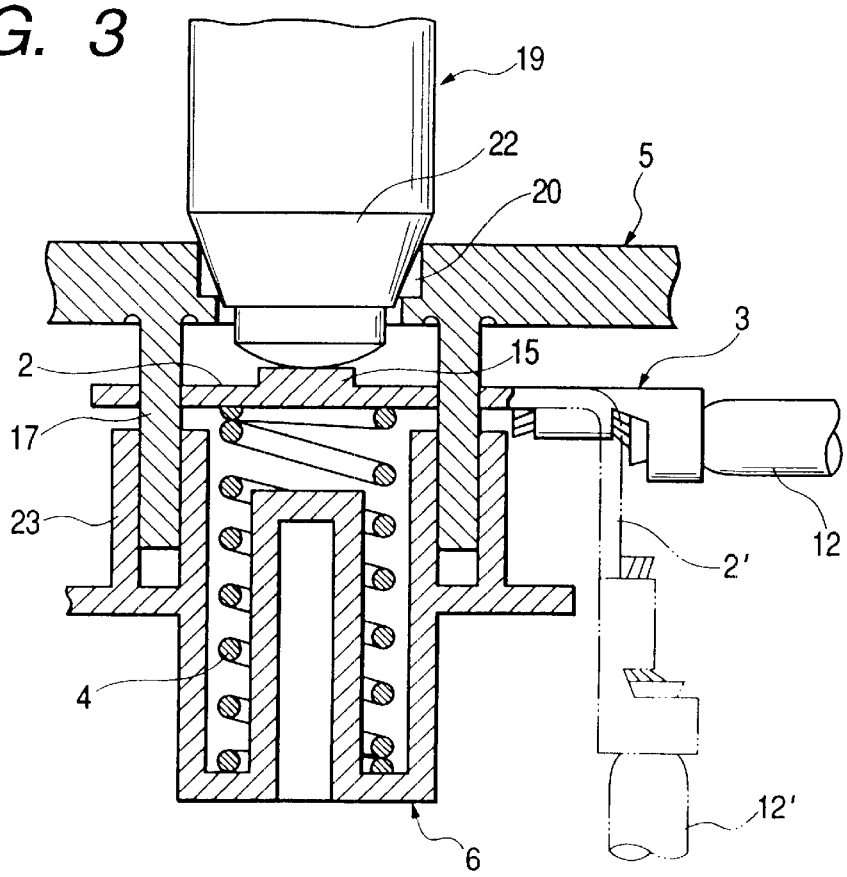
FIG. 3 is a sectional view showing the structure of the butt type contact terminal in a state where the terminal is in contact with a mating terminal.

FIGS. 1 to 3 show one embodiment of a structure of a butt type contact terminal according to the invention.

As shown in FIG. 1, the structure of this butt type contact terminal includes a butt type contact terminal 3 having a thrusting contact face 1 on a tab portion 2, a coil spring (resilient material) 4 for biasing the tab portion 2 in a direction of its thickness, an insulating front holder (a first wall member) 5 made of synthetic resin against which the tab portion 2 is abutted in a biased direction, and an insulating housing (a second wall member) 6 made of synthetic resin which supports the coil spring 4.

The front holder 5 may be in a form of a housing (the first wall member) made of synthetic resin, and the housing 6 may be in a form of a rear holder (the second wall member) made of synthetic resin. In the following description, there is described an embodiment in which the front holder 5 and the housing 6 are employed. The above described butt type contact terminal 3, the coil spring 4, the front holder 5, and the housing 6 constitute a part of a connector 7.

The butt type contact terminal 3 is in a form of an ordinary terminal having the plate-like tab portion (a base plate portion) 2 of a rectangular shape at its one end, and an electric wire press-fitting portion 9 at the other end, as shown in FIGS. 2(*a*) and (*b*). The electric wire press-fitting portion 9 consists of a pair of front press-fitting pieces 10 for press-fitting an exposed conductive section 13 of an electric wire 12, and a pair of rear press-fitting pieces 11 for press-fitting and fixing an insulating covering 14 of the electric wire 12. The electric wire press-fitting portion 9 may be also in a tubular form.

In this embodiment, the tab portion 2 has a disc-shaped thrusting projection 15 substantially at its center in a longitudinal direction, and a flat contact face 15 is provided at a distal end of the thrusting projection 15. An outer diameter of the thrusting projection 15 is rather smaller than a width of the tab portion 2. The thrusting projection 15 may be separately formed from the tab portion 2 and combined to the tab portion 2. The tab portion 2 is provided with a pair of round positioning holes 16 at both sides of the thrusting projection 15. An inner diameter of the positioning hole 16 is smaller than the outer diameter of the thrusting projection 15.

As shown in FIG. 1, a pair of positioning pins 17 of the front holder 5 in an elongated columnar shape are inserted in a pair of the positioning holes 16. The positioning pins 17 project perpendicularly from a back face of a front wall 18 of the front holder 5. The front wall 18 is cut away in a form of an annular groove near base parts of the positioning pins 17. The tab portion 2 of the butt type contact terminal 3 is tightly fitted to the front wall 18 by means of the cut away pat 29 precisely by face contact.

The front wall 18 of the front holder 5 is provided with a round insertion hole 20 for receiving a mating terminal 19 between a pair of the positioning pins 17. The insertion hole 20 is formed in two steps front and back, and a backward step 21 is formed to have a small diameter. The butt type contact terminal 3 is tightly fitted to the back face 18 of the front holder 5 by means of a biasing force of the coil spring 4, and in this state, the thrusting projection 15 enters in a small diametered portion 20*a* of the insertion hole 20 to be positioned therein. The coil spring 4 is mounted between the tab portion 2 and the housing 6 having a length rather contracted than its total length in a free state. A forward end of the coil spring 4 is pressed into contact with a back face of the tab portion 2.

The mating terminal 19 is in a columnar shape, and its forward end is reduced in diameter in a tapered shape. At a forward end of the tapered portion 22, is formed a curved contact portion 30. The contact portion 30 is curved so that a favorable contact can be obtained even when the contact portion 30 is inclinedly abutted against the thrusting projection 15. It is possible to make the contact portion 30 flat while the thrusting contact face 1 is made curved, and it is also possible to make the thrusting contact face 1 recessed in a curved shape with respect the contact portion 30 which is projected in a curved shape.

Respective distal ends of the positioning pins 17 are engaged and fixed in bores 24 formed in a pair of engaging tubes (engaging portions) 23 of the housing 6. Each of the positioning pins 17 is engaged with the engaging tube 23 along a substantially half of its total length, while a remaining half at a side of the base part is exposed. The tab portion 2 of the butt type contact terminal 3 is slidably movable along the exposed part in a direction of its thickness. The engaging tubes 23 project perpendicularly from an intermediate wall 25 of the housing 6.

Intersecting at right angle with the intermediate wall 25 of the housing 6, a large diametered tubular portion 26 is formed in a backward side, a boss portion 28 in a shape of a hollow column is projectingly provided from a bottom wall 27 of the tubular portion 26, and the coil spring 4 is mounted around the boss portion 28. Peripheral walls of the aforesaid engaging tubes 23 are located on an extension of a peripheral wall of the tubular portion 26. A backward end of the coil spring 4 is abutted against the bottom wall 27 of the tubular portion 26, and a forward end of the coil spring 4 is abutted against the back face of tab portion 2 of the butt type contact terminal 3. A total length of the boss portion 28 is about a half of the length of the coil spring 4 in FIG. 1.

A center of the boss portion 28, that is, a center of the coil spring 4, a center of the thrusting projection 15 and a center of the insertion hole 20 are aligned. Because the forward end of the coil spring 4 is in contact with the tab portion 2 concentrically with the thrusting projection 15, when the thrusting portion 15 is brought into contact with the mating terminal 19, the tab portion 2 and the coil spring 4 will not be subjected to a twisting force, and the tab portion 2 can move smoothly back and forth against the biasing force of the coil spring 4. This function can be also attained by arranging the thrusting projection 15 at almost a center in a longitudinal direction of the tab portion 2, and arranging the positioning pins 17 on both sides of the thrusting projection 15. Strength of the coil spring 4, that is, contact pressure of the tab portion 2 with respect to the mating terminal 19 can be adjusted by changing an insertion amount of the positioning pins 17 in a range of a length of the engaging tube 23 of the housing 6.

Assembling of the above described structure of the butt type contact terminal can be simply performed as follows; First, the positioning pins 17 of the front holder 5 are inserted into the positioning holes 16 of the butt type contact terminal 3. At the same time, the coil spring 4 is mounted on the boss portion 28 of the housing 6 from outside. Then, the positioning pins 17 are inserted and fixed in the engaging tubes 23 of the housing 6. The positioning pins 17 may be fixed by press-fitting into the engaging tubes 23, or the front holder 5 and the housing 6 may be fixed to each other by locking means which are not shown.

The tab portion 2 of the butt type contact terminal 3 is pushed by a resilient force of the coil spring 4 into close contact with the front wall 18 of the front holder 5, and the butt type contact terminal 3 becomes movable back and forth along the positioning pins 17 against the biasing force of the coil spring 4. By setting a width of the tab portion 2 to be larger than an inner diameter of the small diametered portion 20*a* of the insertion hole 20, the insertion hole 20 is closed with the tab portion 2, thereby to prevent intrusion of dust or water from the exterior.

The electric wire 12 which is press-fitted to the butt type contact terminal 3 may be guided out along the front wall 18 of the front holder 5. Alternatively, the tab portion 2' may be extended as shown in a dotted lines and folded at a right angle from the base portion to guide the electric wire 12 in a folded direction of the tab portion 2'. Directions of guiding out the electric wire 12 may be set in various (desired directions) directions depending on folding angles of the tab portion 2'.

Figure 5:
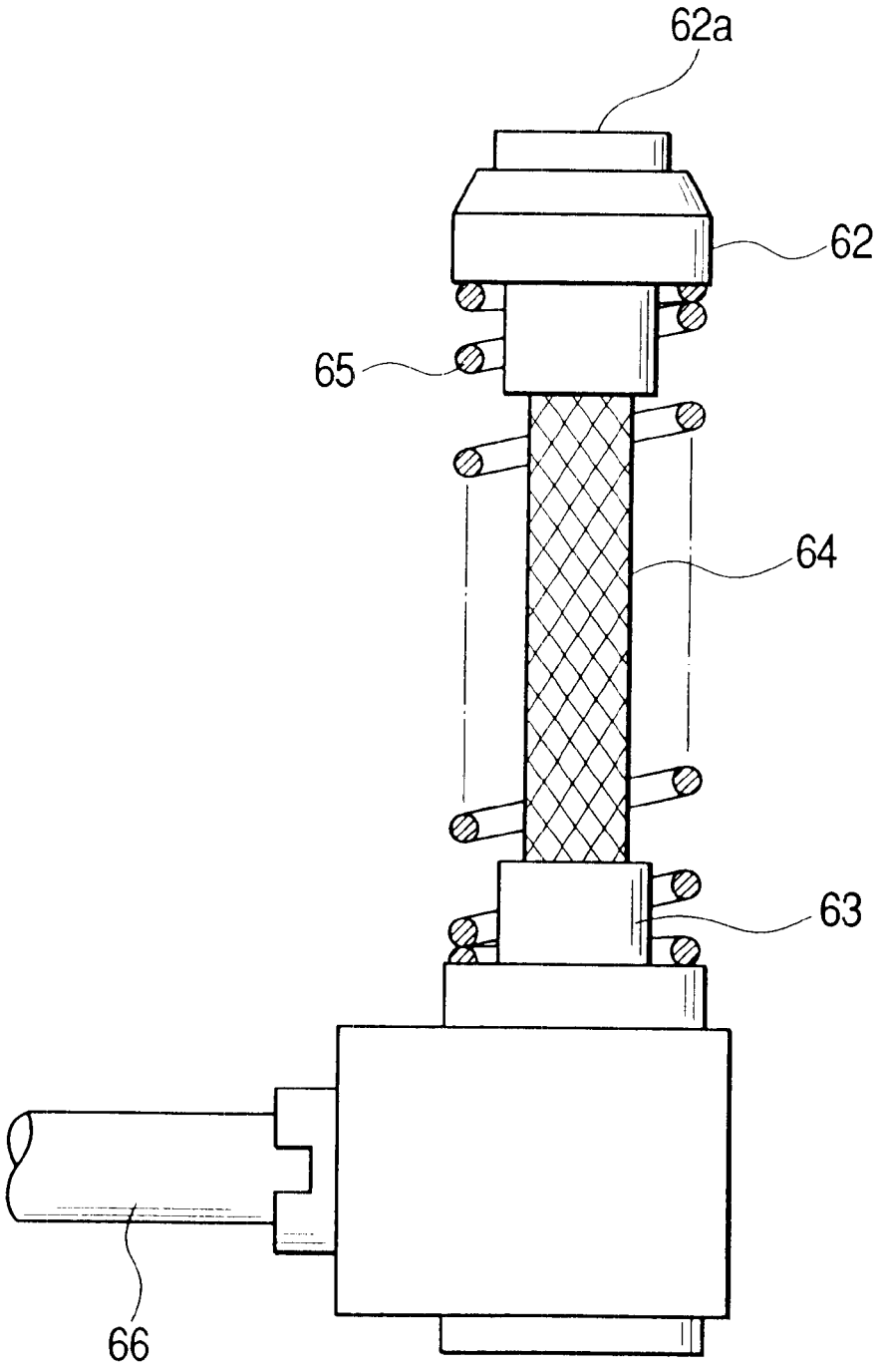
FIG. 5 PRIOR ART
FIG. 5 is a plan view showing a conventional structure.

When the mating terminal 19 is pushed into contact with the butt type contact terminal 3, as shown in FIG. 3, the butt type contact terminal 3 retreats integrally with the electric wire 12 while the tab portion 2 contracts the coil spring 4. Since the tab portion 2 slides in a direction of the thickness, the expanding and contracting actions of the braided wire in the prior art (FIG. 5) can be eliminated. The electric wire 12 swings integrally with the tab portion 2. In case where the electric wire 12 is guided out at the right angle as shown in the dotted line, the electric wire 12 slides in an axial direction.

The mating terminal 19 stops in a state where the tapered portion 22 is abutted against the insertion hole 20 of the front holder 5. On this occasion, the stepped insertion hole 20 is tightly fitted to the tapered portion 22 at two positions front and back, to attain reliable water proofing and dust proofing. A contracting stroke of the coil spring 4, that is, a moving amount of the butt type contact terminal 3 is restricted by a contact of the tapered portion 22 with an end edge of the insertion hole 20. The moving amount of the butt type contact terminal 3 can be changed by varying an angle of the tapered portion 22.

Figure 4:
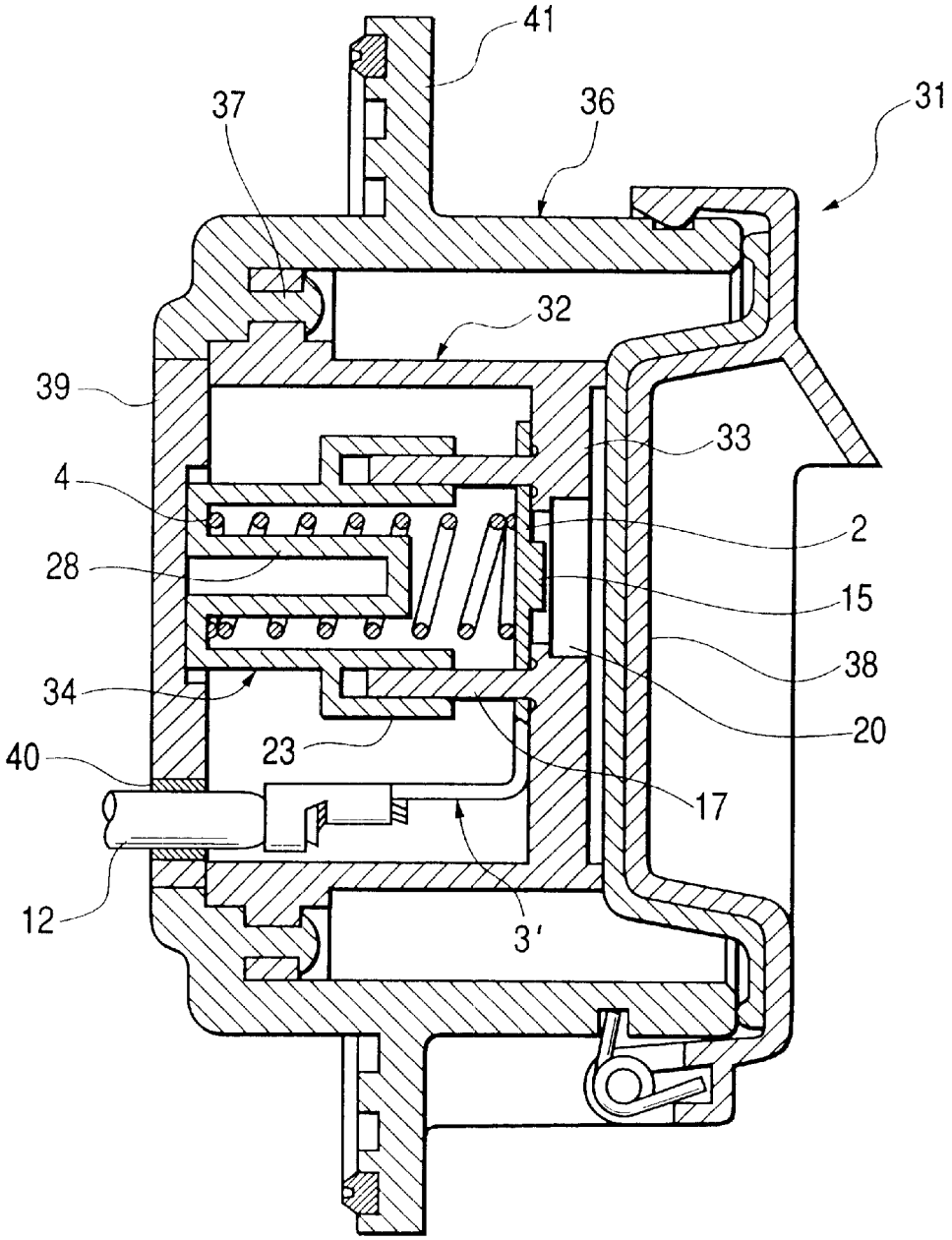
FIG. 4 is a sectional view showing an application example of the structure of the butt type contact terminal.

FIG. 4 shows one embodiment of a connector to which the above described structure of the butt type contact terminal is applied.

This connector 31 is a power receiving connector of an electric car, which is attached to a vehicle body which is not shown, and adapted to receive a battery charge from a power supplying connector (not shown) of an electric stand of course, the above described structure of the butt type contact terminal can be applied to a side of the power supplying connector. Same components as in the above described structure of the butt type contact terminal will be represented by the same reference numerals, and a detailed explanation of the same will be omitted. A terminal for a signal line in the connector 31 is also omitted in the drawing.

A pair of the positioning pins 17 are integrally formed on a front wall 33 of a housing (the first wall member) 32 made of synthetic resin in a projecting manner. The positioning pins 17 engage with the engaging tubes 23 of a rear holder (the second wall member) 34 made of synthetic resin. The coil spring 4 is mounted on the boss portion 28 of the rear holder 34 from outside. The tab portion 2 of the butt type contact terminal 3' is biased forwardly by means of the coil spring 4 and slidable along the positioning pins 17 integrally with the electric wire 12.

The housing 32 is assembled within a casing 36 made of synthetic resin and locked by means of clips 37. A front cover 38 is pivotally supported on the casing 36 so as to be opened and closed in front of the insertion hole 20 in the front wall 33. A rear opening of the casing 36 is closed with a back cover 39 provided with an annular water-proof rubber plug 40, to which the electric wire 12 is tightly fitted so as to slide in an axial direction. The casing 36 is fixed to the vehicle body at a flange portion 41.

By opening the front cover 38 and inserting the power supplying connector (not shown), the mating terminal 19 (FIG. 3) is pushed into contact with the thrusting projection 15 of the butt type contact terminal 3'. The butt type contact terminal 3' retreats integrally with the electric wire 12 against the force of the coil spring 4, and in that state loading of the battery on the vehicle side is performed. After the loading is finished, the power supplying connector (not shown) is detached, and the butt type contact terminal 3' moves forward integrally with the electric wire 12 to be returned by the force of the coil spring 4, and abuts against the front wall 33 of the housing 32. The electric wire 12 slides in contact with an inner diameter portion of the water-proof plug 40.

According to this power receiving connector 31, the butt type contact terminal 3 can be easily set under the force of the coil spring 4, by resin forming the positioning pins 17 integrally with the housing 32, by providing the insertion hole 20 in the housing 32, and by resin forming the engaging tubes 23 and the boss portion 28 integrally with the rear holder 34. Therefore, a reliable connection of the butt type contact terminal 3 with the mating terminal 19 (FIG. 3) can be obtained with a simple structure.

Because the butt type contact terminal 3 has a shape similar to an existing terminal for a wire harness besides the power receiving connector 31 and the power supplying connector, the existing terminal can be commonly used provided that the thrusting projection 15 is not provided, and thus the cost will be saved. The thrusting projection 15 serves to increase thrusting strength with respect to the mating terminal 19 and to prevent deformation and wear of the tab portion 2. Provided that the thickness of the tab portion 2 is sufficiently large, the thrusting projection 15 may be eliminated. Further, elastic material such as rubber, urethane, sponge or the like which is not shown can be used instead of the coil spring 4.

As described above, according to the present invention, the existing terminal having the tab portion for contact can be commonly used and the cost will be saved. Moreover, because the structure is simple with the butt type contact terminal having the plate-like tab portion and the resilient member for biasing the tab portion in the direction of the thickness, the structure will cause least trouble and the price will be low. Further, since the tab portion is so designed as to move back and forth in a direction of the thickness while it is biased in the direction of the thickness and the tab portion is in a form of a plate, not a large space is required and a compact structure is realized. Still further, because a large area of the contact face of the tab portion with respect to the mating terminal can be obtained, a reliable contact can be attained even though the mating terminal is axially offset from the contact face. In addition, because the conventional braided wire is not used, the terminal will not be damaged after the repeated contacts with the mating terminal, and a long life can be assured.

According to the present invention, the strength of the tab portion will be increased by the thrusting projection, which eliminates a fear of bending deformation or thrusting wear of the tab portion. According to the present invention, the electric wire can be press-fitted and connected to the electric wire press-fitting portion in a same manner (on a same line) as the existing terminal for the wire harness, and the wire connecting work can be easily conducted.

According to the present invention, the position of the tab portion is accurately defined by inserting the positioning pins into the positioning holes, and the tab portion becomes slidable along the positioning pins. Thus, a posture of the tab portion at the forward and backward movements will be stabilized, and the reliable contact with the mating connector can be realized. Since the tab portion is pressed into contact with the first wall member by the biasing force of the resilient member, an initial position of the tab portion in the direction of the thickness (a position where it is not in contact with the mating connector) can be accurately defined. According to the present invention, as the positioning pins engage with the engaging portions, the position of the resilient member on the second wall member with respect to the tab portion can be accurately defined, and the resilient member accurately presses the required position of the tab portion.

According to the present invention, the mating terminal inserted into the insertion hole is thrust onto the contact face of the tab portion to be brought into contact therewith. In a state it is not in contact with the mating terminal, the tab portion will close the insertion hole thereby to prevent an intrusion of dust or so. According to the present invention, as the thrusting projection enters into the insertion hole, the space of the thrusting projection will be absorbed, thereby to realize a compact structure. According to the present invention, by abutting the tapered portion of the mating terminal against the end edge of the insertion hole, an insertion amount of the mating terminal with respect to the tab portion, that is, the moving amount of the tab portion in the direction of the thickness will be restricted. Therefore, there will be no need of a stopper for the tab portion, and a simple structure will be obtained. By adequately setting an angle of the tapered portion, the moving amount of the tab portion can be easily changed. Since the tapered portion is tightly fitted to the end edge of the insertion hole, an intrusion of dust or so during the contact of the terminals can be prevented.

According to the present invention, by adequately setting the folding angle of the tab portion, the electric wire can be guided out in a desired direction. This enlarges flexibility of the design of the connector or the like to which the structure of the butt type contact terminal is applied.

What is claimed is:

1. A structure of a butt type contact terminal comprising:

a butt type contact terminal having a plate-like tab portion, one face of said tab portion serving as a contact face;

a resilient member which is pressed into contact with the other face of said tab portion, wherein said tab portion is adapted to move in a direction of its thickness against a biasing force of said resilient member when a mating terminal is pressed into contact with said contact face;

positioning holes provided with said tab portion; and positioning pins to be inserted in said positioning holes provided on a first wall member, said tab portion being adapted to be pressed into contact with said first wall member by said biasing force of said resilient member.

2. A structure of a butt type contact terminal as claimed in claim 1, further comprising:

engaging portions, with which forward ends of said positioning pins are engaged, provided on a second wall member, and said resilient member supported by said second wall member.

3. A structure of a butt type contact terminal as claimed in claim 2, wherein said first wall member is provided with an insertion hole for receiving said mating terminal, and said one face of said tab portion faces with said insertion hole.

4. A structure of a butt type contact terminal as claimed in claim 3, wherein said thrusting projection is positioned in said insertion hole.

5. A structure of a butt type contact terminal as claimed in claim 3, wherein a tapered portion of said mating terminal is abutted against an end edge of said insertion hole.

6. A structure of a butt type contact terminal as claimed in claim 1, wherein said first wall member is provided with an insertion hole for receiving said mating terminal, and said one face of said tab portion faces with said insertion hole.

7. A structure of a butt type contact terminal comprising:

a butt type contact terminal having a plate-like tab portion, at one end and an electric wire connecting portion on the other end, one face of said tab portion serving as a contact face; and a resilient member pressed into contact with the other face of said tab portion, wherein said tab portion moves in a direction of its thickness against a biasing force of said resilient member when a mating terminal is pressed into contact with said contact face, and wherein said tab portion is provided with a thrusting projection having said contact face and, further comprising:

positioning holes provided with said tab portion; and positioning pins to be inserted in said positioning holes provided on a first wall member, said tab portion being adapted to be pressed into contact with said first wall member by said biasing force of said resilient member.

8. A structure of a butt type contact terminal as claimed in claim 7, further comprising:

engaging portions, with which forward ends of said positioning pins are engaged, provided on a second wall member, and said resilient member supported by said second wall member.

9. A structure of a butt type contact terminal comprising:

a butt type contact terminal having a plate-like tab portion, one face of said tab portion serving as a contact face;

a resilient member which is pressed into contact with the other face of said tab portion, wherein said tab portion is adapted to move in a direction of its thickness against a biasing force of said resilient member when a mating terminal is pressed into contact with said contact face, and wherein said butt type contact terminal includes an electric wire press-fitting portion, positioning holes provided with said tab portion; and positioning pins to be inserted in said positioning holes provided on a first wall member, said tab portion being adapted to be pressed into contact with said first wall member by said biasing force of said resilient member.

10. A structure of a butt type contact terminal as claimed in claim 9, further comprising:

engaging portions, with which forward ends of said positioning pins are engaged, provided on a second wall member, and said resilient member supported by said second wall member.

11. A structure of a butt type contact terminal as claimed in claim 9, wherein said tab portion is folded, and an electric wire extending from said electric wire press-fitting portion is guided out in a folded direction of said tab portion.

12. A structure of a butt type contact terminal comprising:

a butt type contact terminal having a plate-like tab portion, at one end and an electric wire connecting portion on the other end, one face of said tab portion serving as a contact face; and a resilient member pressed into contact with the other face of said tab portion, wherein said tab portion moves in a direction of its thickness against a biasing force of said resilient member when a mating terminal is pressed into contact with said contact face and, wherein said tab portion is provided with a thrusting projection having said contact face, wherein said butt type contact terminal includes an electric wire press-fitting portion and, further comprising:

positioning holes provided with said tab portion; and positioning pins to be inserted in said positioning holes provided on a first wall member, said tab portion being adapted to be pressed into contact with said first wall member by said biasing force of said resilient member.

13. A structure of a butt type contact terminal as claimed in claim 12, further comprising:

engaging portions, with which forward ends of said positioning pins are engaged, provided on a second wall member, and said resilient member supported by said second wall member.

* * * * *